US005165300A

United States Patent [19]

Yagi

[11] Patent Number: 5,165,300

[45] Date of Patent: Nov. 24, 1992

[54] FRICTION MECHANISM FOR CONTROL APPARATUS

[75] Inventor: Mikiya Yagi, Takarazuka, Japan

[73] Assignee: Nippon Cable System, Inc., Takarazuka, Japan

[21] Appl. No.: 805,548

[22] Filed: Dec. 10, 1991

[30] Foreign Application Priority Data

Dec. 17, 1990 [JP] Japan ..... 2-400806

[51] Int. Cl.[5] ..... G05G 5/06

[52] U.S. Cl. ..... 74/531

[58] Field of Search ..... 74/531

[56] References Cited

U.S. PATENT DOCUMENTS

| | | | |
|---|---|---|---|
| 3,208,300 | 9/1965 | Morse | 74/531 |
| 4,751,850 | 6/1988 | Nagano | 74/531 X |
| 4,815,330 | 3/1989 | Nagano | 74/531 X |
| 4,896,557 | 1/1990 | Nagano | 74/531 |
| 4,919,004 | 4/1990 | Nagano | 74/531 X |
| 4,930,368 | 6/1990 | Nagano | 74/531 X |

*Primary Examiner*—Leslie A. Braun
*Assistant Examiner*—Nicholas Whitelaw
*Attorney, Agent, or Firm*—Varnum, Riddering, Schmidt & Howlett

[57] ABSTRACT

A friction mechanism for control apparatuses is for use in a control apparatus provided with a discoidal accelerator wheel supported in a freely rotating manner in a housing member and for applying frictional resistance to the said accelerator wheel. The said friction mechanism consists of a friction block supported in the housing member so as to mate with the accelerator wheel in the vicinity of its rim, a pressing member for pressing the friction block supported in the housing member in a direction axial to the accelerator wheel, and a conversion mechanism for converting the pressing force of the said pressing member (a chief constituent of which is the inclined surface formed on the friction block) from the said axial direction to a direction inclined toward the center of the accelerator wheel.

4 Claims, 3 Drawing Sheets

FRICTION MECHANISM FOR CONTROL APPARATUS

BACKGROUND OF THE INVENTION

The present invention relates to a friction mechanism for control apparatuses. More specifically, it relates to a friction mechanism for a control lever in a single-lever-type control apparatus for controlling engines in small vessels and the like.

The control lever in a control apparatus operates the clutch and accelerator through a control cable. A control lever is generally operated as follows. The neutral position is in the center. Inclining the lever forward shifts the clutch into forward, and moving the lever farther ahead opens the accelerator throttle valve. Conversely, moving the lever backward from the neutral position shifts the clutch into reverse, and moving it farther back opens the throttle valve.

Fine accelerator adjustments are difficult and it is dangerous when the control lever can be inclined under too little force during accelerator manipulation. Resistance during lever movement becomes unstable because it is governed mainly by engine parts, frictional resistance of rotating parts in the control apparatus, sliding friction on the control cable and the like. This instability complicates accelerator adjustment.

Thus, friction mechanisms for applying a virtually uniform resistance to the control lever are provided in the prior art in order to obtain a consistently stable response.

For example, in control apparatus 51 in FIG. 6, the base of the control lever 52 and a discoidal accelerator wheel 54, housed in a wheel case 53, are connected through a shaft 55 which is concentric to the accelerator wheel 54.

A gear 57 connected to a linking mechanism (not pictured) for pushing and pulling the control cable 56 and plural concavities 58 which constitute a detent mechanism are formed in one region of the outer circumference of the accelerator wheel 54 (see FIG. 7).

The following friction mechanism is also provided. Here, friction block 59 in the above wheel case 53 is pressed against the side surface 54*a* of the accelerator wheel 54 by screw 60, provided parallel to the axis of the accelerator wheel 54. Friction is thereby applied against the rotation of the accelerator wheel 54, and, as a result, a uniform resistance can be applied against inclinations of the control lever 52.

Low frictional resistance is generally a problem of the prior art friction mechanisms. In order to apply strong resistance, friction block 59 must be large, but the size of the friction block 59 is limited by the gear 57 on accelerator wheel 54 and by the concavities 58.

Furthermore, because of mounting space limitations, the prior art friction mechanisms are constructed in such a way that the screw 60, positioned axially to the accelerator wheel 54, applies pressure, through the friction block 59, to only a single point on the side 54*a* of the accelerator wheel 54. Consequently, if there is any play in the direction in which this pressure is applied, the wheel 54 tilts, causing both a poor response and control failures.

SUMMARY OF THE INVENTION

The present invention was devised to solve such problems, its object is to provide a friction mechanism which provides an appropriate frictional force, which is not significantly influenced by play in the wheel case, and which has an extremely compact geometry.

The friction mechanism for control apparatuses of the invention is for use in a control mechanism provided with a discoidal accelerator wheel freely rotating inside a housing member and for applying frictional resistance to the said accelerator wheel. The said friction mechanism consists of a friction block supported in the housing member so as to mate with the accelerator wheel in the vicinity of its rim, a pressing member for pressing the friction block supported in said housing member in a direction axial to the accelerator wheel, and a conversion mechanism for converting the pressing force of the said pressing member (a chief constituent of which is the inclined surface formed on the friction block) from the said axial direction to a direction inclined toward the center of the accelerator wheel.

The said conversion mechanism may consist of the inclined surface and a projection protruding from the housing member in such a way that it can mate with the inclined surface. Or the conversion mechanism may consist of only the inclined surface formed in such a way that it mates with the pressing member.

Furthermore, it is preferred that the said friction block possess a notch which slides on the surfaces of the rim and side of the accelerator wheel simultaneously.

In a friction mechanism for a control apparatus constituted as described hereinabove, the conversion mechanism converts pressing force of the pressing member to a force in an inclined direction, i.e., in a direction composed of an axial component and a lateral component (a component oriented toward the center of the accelerator wheel). As a result, the lateral component of the pressing force creates friction between the circumference of the accelerator wheel and the friction block, and the axial component creates friction between the side surface of the accelerator wheel and the friction block. A consistently stable, laterally oriented frictional force which is unaffected by the inclination or flexure in the accelerator wheel is thereby created.

In the present invention, as in the prior art devices, the pressing member is provided axially to the accelerator wheel because of space limitations. By virtue of the conversion mechanism, however, it is possible to obtain a stable frictional force by creating a component of force acting on the acceleration wheel in a direction axial to the wheel.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
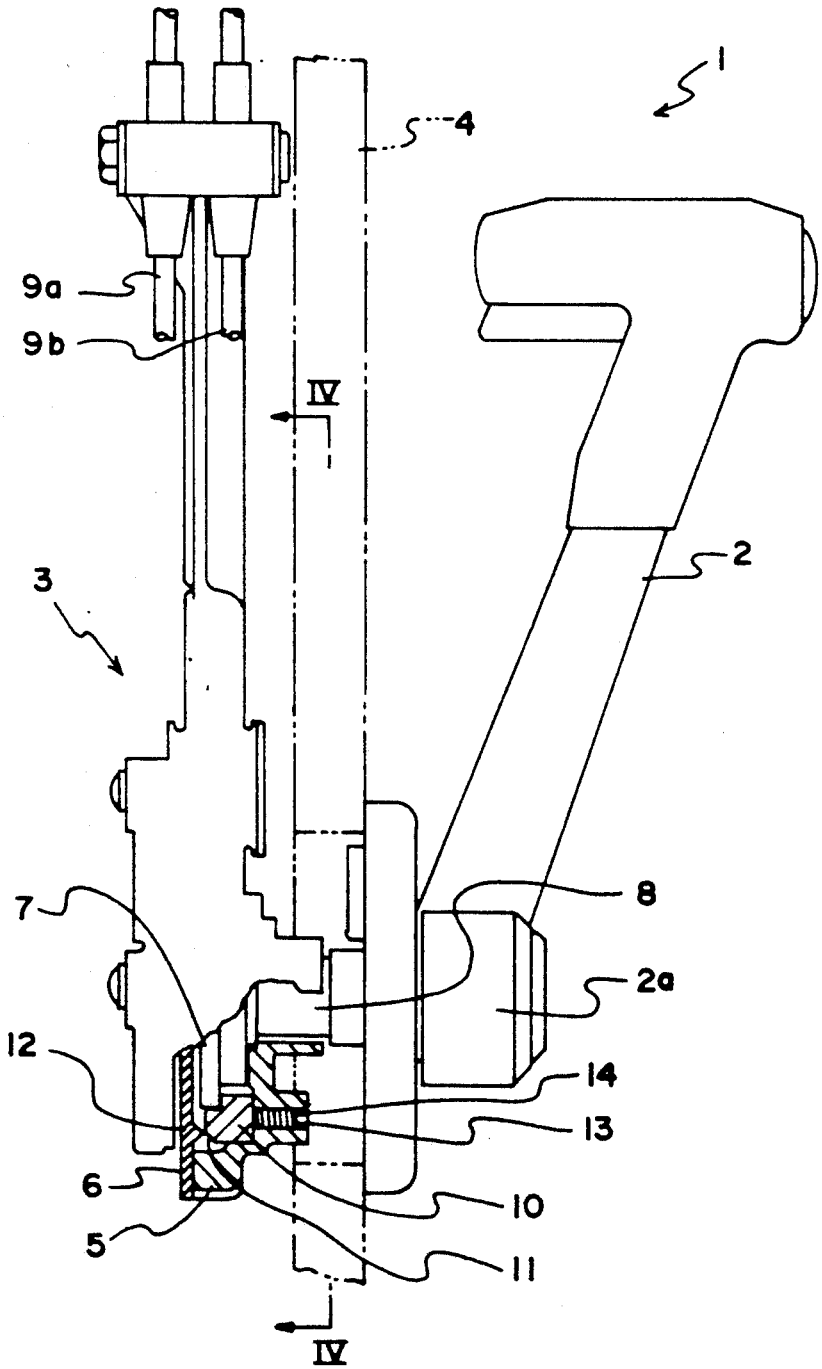
FIG. 1 is a cross-sectional view of the main elements of an embodiment of a friction mechanism of the invention mounted in a control apparatus.

In FIG. 1, 1 is a control apparatus composed of control lever 2 and main body 3.

Figure 4:
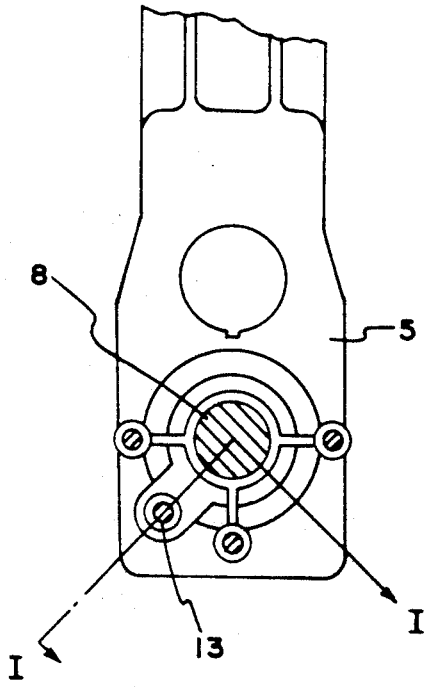
FIG. 4 is a cross-sectional view along the line (IV-)—(IV) of FIG. 1.

The cut-away cross-section in FIG. 1 is for purposes of clarity; it is a cross-section of the area marked (I)—(I) in FIG. 4. The accelerator wheel 7 and shaft 8, mentioned below, are not shown in cross-section.

Main body 3 is mounted on, for example, a board 4 of the vessel structure. Main body 3 is provided with a wheel case 5, a cover plate 6 which positioned so as to cover the wheel case 5; a discoidal accelerator wheel 7 housed in wheel case 5; and a shaft 8 which is fixed in the center of accelerator wheel 7. The end of the shaft projects from the wheel case 5 and is connected to the base member 2*a* of the control lever.

Therefore, by inclining the control lever 2, the accelerator wheel 7 can be simultaneously rotated only the same angle in the same direction of control lever 2.

Two control cables 9*a* and 9*b*, respectively connected at one to the accelerator and clutch (neither of the latter is pictured) are run inside main body 3, the other ends of the cables being connected to linking mechanism (not pictured).

Figure 2:
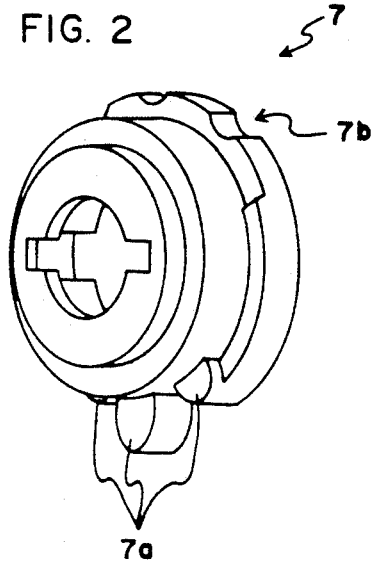
FIG. 2 is a perspective view of accelerator wheel in the apparatus in FIG. 1.

Gears 7*a* which are connected to linking mechanisms (not pictured) for pushing and pulling the said control cables 9*a*, 9*b* and plural concavities 7*b* constituting a detent mechanism are formed in regions of the rim of the accelerator wheel 7 (see FIG. 2).

A friction block 10 for applying frictional resistance to the rotation of accelerator wheel 7 is situated around the outer periphery of accelerator wheel 7; both sides and the back of the friction block 10 are surrounded by a section of wheel case 5.

Figure 3:
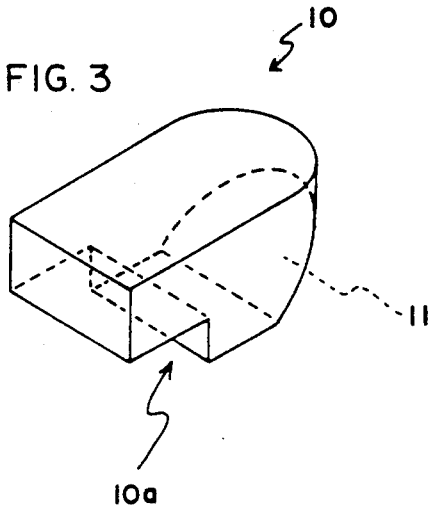
FIG. 3 is a perspective view of the frictional block in the apparatus in FIG. 1.

As shown in FIG. 3, a substantially perpendicular notch 10*a* which simultaneously comes into contact with the side and circumferential surfaces of the accelerator wheel 7 is formed in friction block 10. The area at which the outer circumferential surface of friction block 10 and the surface facing cover plate 6 (hereinafter, bottom surface) intersect is cut out at an angle to form inclined surface 11. This inclined surface is inclined at an angle of about 45° from the central axis of accelerator wheel 7. Conical projection 12, projecting from the upper surface of the cover plate 6, comes into contact with this inclined surface 11.

Screw 13 for pushing the friction block 10 in a direction parallel to the axis of the accelerator wheel 7 (hereinafter, axial direction) is fastened in threaded hole 14 of wheel case 5 (see FIG. 1). When pushed axially, friction block 10 moves in the direction of the above inclined surface 11 which slides over the conical projection 12. As a result, since the notch 10*a* presses against the side and circumferential surfaces of the accelerator wheel 7 simultaneously, frictional resistance is created due to axial force and lateral force (perpendicular to the central axis) against the rotation of the accelerator wheel 7. Since the friction block 10 always presses on the accelerator wheel 7 laterally, movement is restricted by accelerator wheel 7 and does not follow play in the mechanism. Thus, stable resistance can be provided to control lever 2 without significant fluctuations due to play between the wheel case 5 and the accelerator wheel 7. In addition, response and actual shift and throttle operation are not adversely affected because the accelerator wheel 7 is not inclined.

Figure 5:
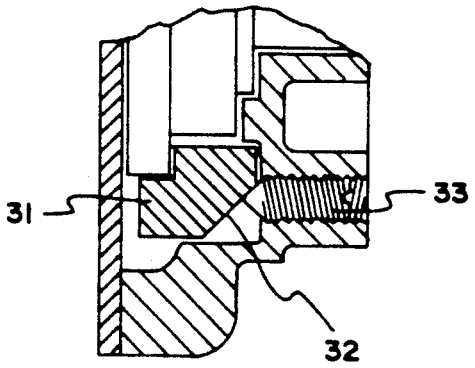
FIG. 5 is a cross-sectional view of the chief elements in another embodiment of the friction mechanism.
Figure 6:
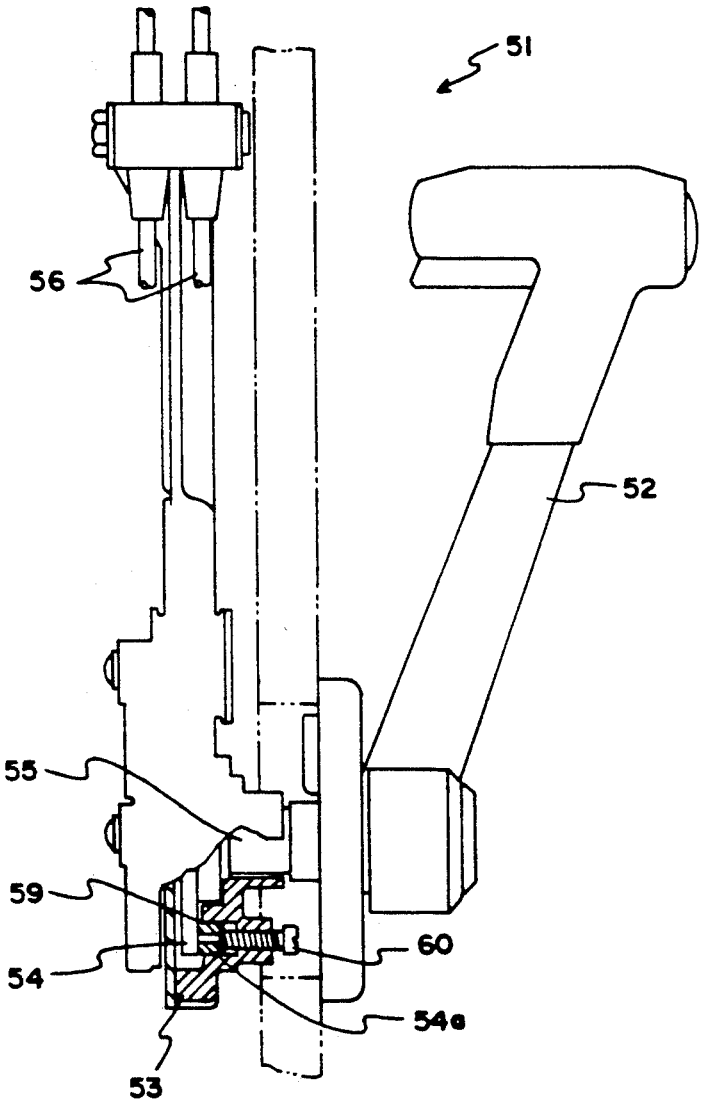
FIG. 6 PRIOR ART
FIG. 6 is a cross-sectional view of the main elements in an example of a prior art friction mechanism.
Figure 7:
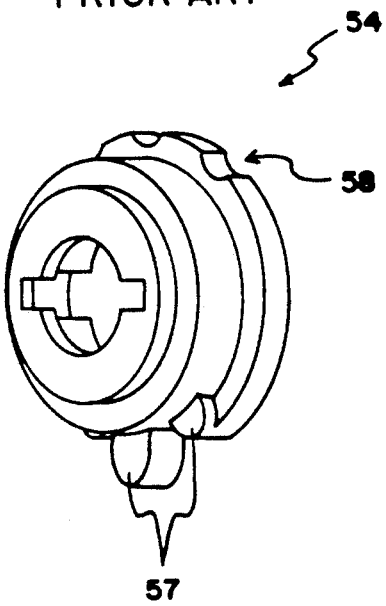
FIG. 7 PRIOR ART
FIG. 7 is a perspective view of the accelerator wheel in FIG. 6.

Another embodiment of the friction mechanism of the present invention is shown in FIG. 5.

This example is not provided with the projection 12 of the previous embodiment; rather, an inclined surface 32 is formed on the upper surface instead of the lower surface of the friction block 31. In other words, this inclined surface 32 is rotated 180° from the inclined surface 11 in the previous example. Thus, it is inclined outward about 45° from the axial direction. The pressing member, screw 33, comes directly into contact with the friction block 31. Consequently, in this friction mechanism, like that of the previous example, downward pressing force from screw 33 acts diagonally on friction block 31 through the inclined surface 32, manifesting an effect identical to that of the friction mechanism of the previous example.

The friction mechanism of the present invention is compact, it can provide significant frictional force and overcome play in the wheel case.

Reasonable variation and modification are possible within the scope of the foregoing disclosure without departing from the spirit of the invention.

I claim:

1. A friction mechanism for use in a control apparatus provided with a discoidal accelerator wheel supported in a freely rotating manner inside a housing member and for applying frictional resistance to the said accelerator wheel, the friction mechanism comprises a friction block supported in the housing member so as to mate with the said accelerator wheel near rim, a pressing member for pressing the friction block supported in the said housing member in a direction axial to the accelerator wheel, and a conversion mechanism for converting the pressing force of the said pressing member, a chief constituent of which is an inclined surface formed on the friction block, from the said axial direction to a direction inclined toward the center of the accelerator wheel.

2. The friction mechanism in claim 1, wherein the conversion mechanism consists of the said inclined surface and a projection provided in the housing member so as to mate with the said inclined surface.

3. The friction mechanism in claim 1, wherein the said conversion mechanism comprises only the inclined surface constituted so as to mate with the said pressing member.

4. The friction mechanism in claim 1, wherein the friction block possesses a notch whereby the friction block slides on the circumferential and side surfaces of the accelerator wheel simultaneously.

* * * * *

UNITED STATES PATENT AND TRADEMARK OFFICE
CERTIFICATE OF CORRECTION

PATENT NO. : 5,165,300

DATED : November 24, 1992

INVENTOR(S) : MIKIYA YAGI

It is certified that error appears in the above-identified patent and that said Letters Patent is hereby corrected as shown below:

Claim 1, column 4:

Line 31, "for use" should be deleted.

Line 33 "and" should be deleted.

Line 38 "said" should be deleted.

Line 38, "near rim" should read --near the rim of the accelerator wheel--

Lines 40, 43 and 45, "said" should be deleted.

Claim 2, column 4, lines 49 and 51, "said" should be deleted.

Claim 3, column 4, lines 52 and 54, "said" should be deleted.

Signed and Sealed this

Twenty-third Day of November, 1993

*Attest:*

Bruce Lehman

BRUCE LEHMAN

*Attesting Officer*

*Commissioner of Patents and Trademarks*